United States Patent [19]

Hansen

[11] 4,155,699

[45] May 22, 1979

[54] HEAT SAVING DEVICE FOR SPACE HEATING FURNACE

[76] Inventor: Keith A. Hansen, 580 N. 6th East, Brigham City, Utah 84302

[21] Appl. No.: 807,904

[22] Filed: Jun. 20, 1977

[51] Int. Cl.[2] ..... F23N 3/00

[52] U.S. Cl. ..... 431/20; 236/1 G; 126/285 B

[58] Field of Search ..... 236/1 G, 15 BD, 16; 126/285 B, 116 A, 85 B; 110/163; 431/20

[56] References Cited

U.S. PATENT DOCUMENTS

| | | | |
|---|---|---|---|
| 1,955,622 | 4/1934 | Dayton | 431/20 X |
| 2,037,363 | 4/1936 | Branche | 126/285 B |
| 2,937,697 | 5/1960 | Johnston | 431/20 |
| 3,951,051 | 4/1976 | Dry | 126/285 B X |
| 4,021,187 | 5/1977 | Schulte et al. | 126/285 B X |

*Primary Examiner*—Andrew V. Kundrat

*Attorney, Agent, or Firm*—Mallinckrodt & Mallinckrodt

[57] ABSTRACT

An improvement in space heating furnaces fueled by gas or liquid for saving heat ordinarily lost through the draft system of such a furnace, comprises a means of automatically closing the air inlet to the combustion chamber as well as the air inlet to the diverter air opening at the flue immediately after cessation of the main burner flame, and also for opening both of the air inlets immediately prior to the ignition of the main burners.

6 Claims, 5 Drawing Figures

FIG. 1.
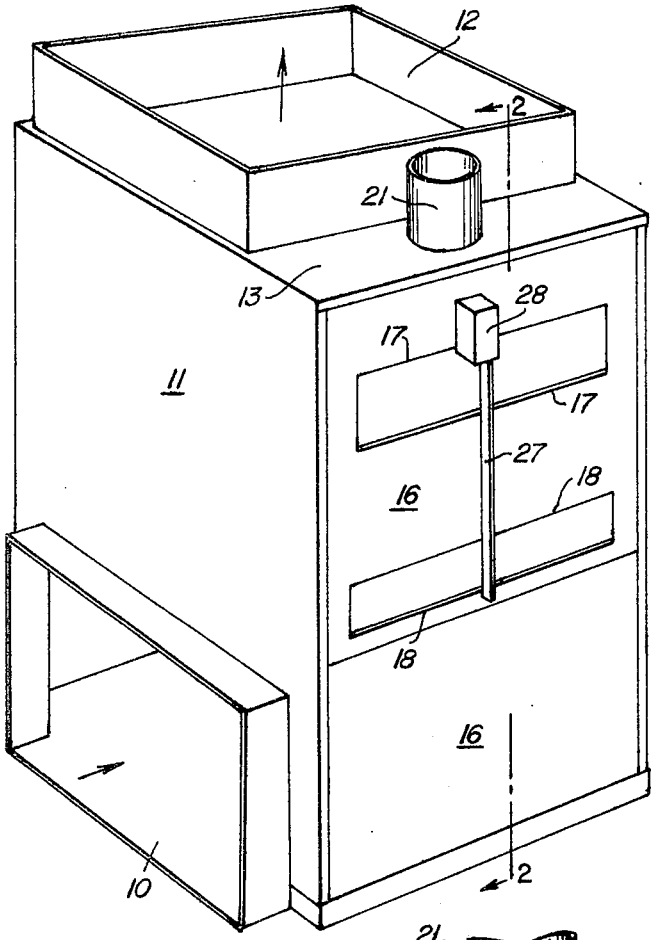
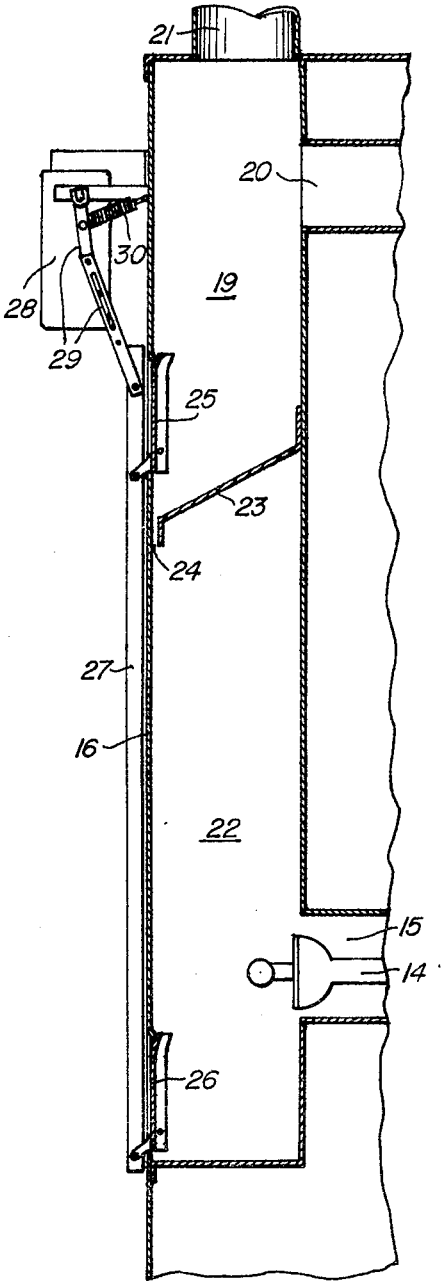
FIG. 2.
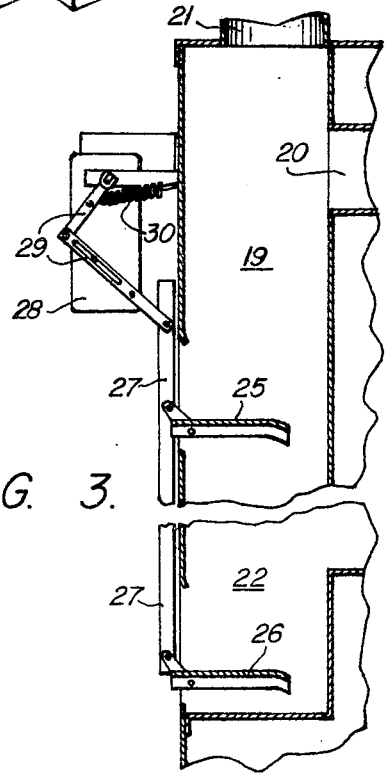
FIG. 3.

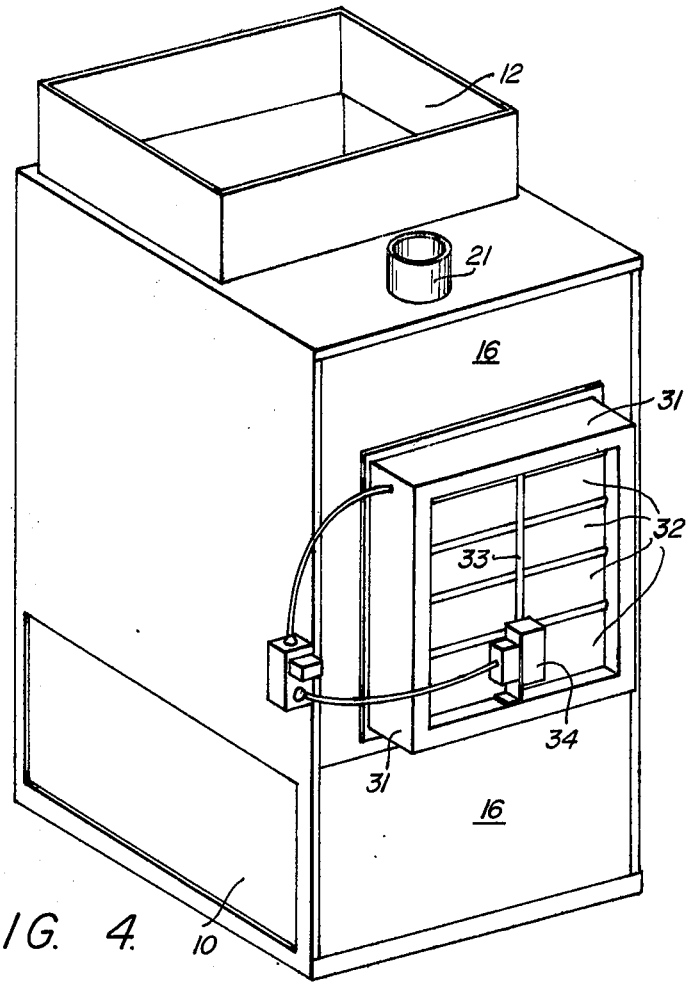
FIG. 4.
FIG. 5.
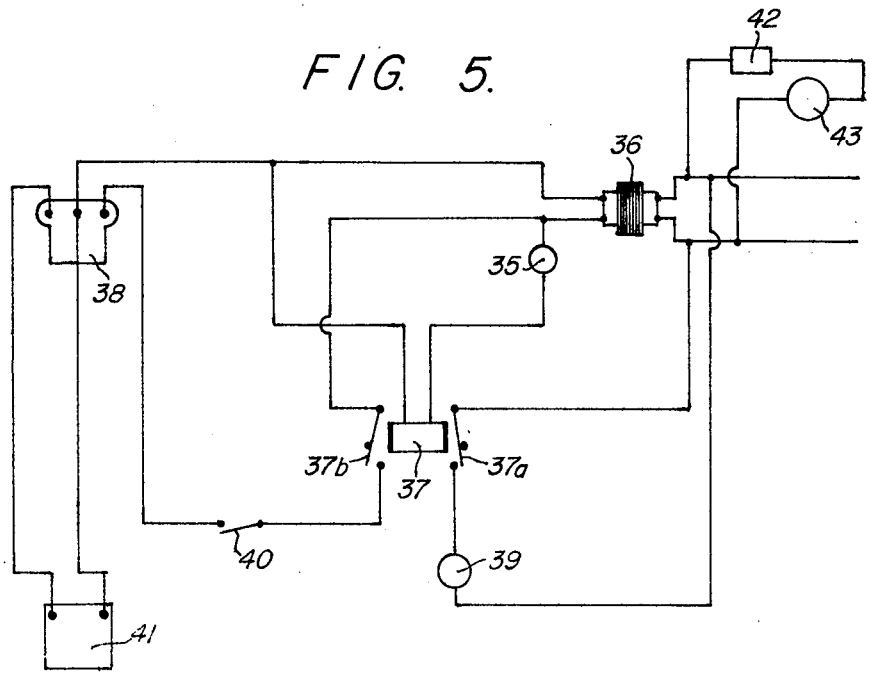

HEAT SAVING DEVICE FOR SPACE HEATING FURNACE

BACKGROUND OF THE INVENTION

Field: The invention is in the field of gas or liquid fueled space heating furnaces which draw combustion air from the inside of the buildings which they heat or from a separate fresh air supply connected to an external source and exhaust the combustion gases exteriorly of the buildings.

State of the Art: Furnaces fueled by various kinds of gases such as natural gas, methane, propane, etc., or liquids, such as fuel oil, are customarily used for space heating of buildings and other enclosures of various kinds. Hot air furnaces fueled by natural gas are widely used for heating the interior of homes. Such space heating furnaces have been constructed in many different ways, but in all cases, they require a fresh air supply, wherein the fresh air is either drawn from the interior of the building or, in some special cases, from a separate connection which conducts the fresh air directly from the exterior of the building into the furnace area. Combustion gases are exhausted from the combustion chamber to a flue which conducts the gas by way of a stack or chimney to the atmosphere exteriorly of the building. To provide proper draft in the flue, air from the fresh air supply is drawn into the flue through a diverter air opening therein.

A significant waste of energy results during periods when the furnace is not operating, i.e., when fuel is not being burned in the furnace, as a result of:

a. Heat loss due to warm air escaping to the exterior of the building through the air inlet to the combustion chamber and the air drawn into the flue through the diverter air opening in the flue.

b. Unnecessary cooling of the furnace heat exchanger which is caused by heat transfer from the previously heated surfaces of the heat exchanger to the air being exhausted to the exterior of the building via the flue.

To alleviate these heat losses, it has been suggested that dampers be installed in the exhaust flues of such furnaces, and it is a common expedient to utilize such dampers in coal-burning furnaces and fireplaces. However, similar dampers in modern automatically controlled gas and liquid fueled furnaces have been considered to be highly dangerous. An extreme hazard exists if the burner of the furnace to which such a damper is attached comes on without the damper opening the vent or flue.

Objective: The objective of this invention was to develop a reliable, safe mechanism by which gas flow through the draft system of the furnace is automatically closed when the burner is not operating and opened when it is operating.

SUMMARY OF THE INVENTION

In accordance with the invention, the foregoing objective is achieved by providing an improvement in the draft systems of space heating furnaces which burn gas or liquid fuels and are commonly used to heat homes and other buildings. Such draft systems comprise a combustion air inlet and passages which allow air to be drawn into the combustion chamber from the inside of the building being heated or from fresh air conducted directly from the exterior of the building. A flue conducts exhaust gases to a stack or chimney which vents the combustion gases to the exterior of the building being heated. A diverter air inlet and passages for conducting air to the flue are usually provided, so that air from the inside of the building or from air obtained directly from the exterior of the building can be drawn into the flue to provide a proper draft.

The improvement of the present invention comprises the provision of means for automatically closing and opening the combustion air inlet and the diverter air inlet of the draft system in response to preset conditions occurring in the operation of the furnace. The combustion air inlet and the diverter air inlet are closed when fuel is not being burned, and opened immediately prior to ignition of the burners and during the period when fuel is being burned. Thus, during intermittent periods when the furnace is not in operation, i.e., when fuel is not being fed to the burner of the furnace and heat is not being produced, the combustion air inlet and the diverter air inlet are closed, thereby preventing loss of heated air from the inside of the building through the draft system of the furnace, or loss of heat due to the premature cooling of the heat exchanger in the furnace caused by the flow of the cooler interior building air or the flow of the cold air being drawn from the fresh air which is drawn from the exterior of the building in those instances where the fresh air supply to the furnace is air drawn from the exterior of the building. When the furnace comes on, i.e., when fuel is to be fed to the burner and be burned in the combustion chamber, the combustion air inlet opens and allows the normal supply of combustion air to flow into the combustion chamber, and the diverter air inlet opens so that air can be drawn into the flue to establish a proper draft.

In a preferred embodiment of the invention, a shutter means is provided over the combustion air inlet and similarly over the diverter air inlet, with means for automatically opening and closing the shutter means when the furnace is operating and when it is on standby between periods of operation, respectively. The shutter means is preferably spring biased to hold it in the closed position, and a motor drive is provided to counteract the spring bias and thereby open the shutter against the force of such spring bias when the motor drive is energized. Means are provided for energizing the motor drive during those periods when the furnace is operating, i.e., when fuel is being burned in the combustion chamber. When the furnace shuts down to its standby condition, the motor drive is de-energized and the shutter closes under the force of the spring.

The operation of the motor drive is advantageously controlled by the thermostat, which is commonly employed on furnaces of the type concerned herewith to control the automatic fuel control valve and thereby the flow of fuel to the combustion chamber of the furnace. When the thermostat indicates a need for heat, it energizes a relay which in turn energizes the motor drive causing the shutter to open, thereby permitting air to flow through the combustion air inlet to the combustion chamber and through the diverter air inlet to the flue. When the shutter reaches the "full open" position, a switch is tripped, closing the circuit which activates the fuel control valve, thus introducing the fuel into the combustion chamber for ignition. The shutter remains open as long as the thermostat indicates a need for heat and, therefore, as long as fuel is being burned in the furnace. As soon as the heat requirement has been satisfied, the thermostat de-energizes the relay which de-energizes the drive motor causing the shutter to close under the spring force. The closing action of the shutter releases the switch which de-energizes the fuel control valve, thus stopping the flow of fuel into the combustion chamber, thereby eliminating the need for air flow to the combustion chamber or to the diverter air inlet.

THE DRAWINGS

The best mode presently contemplated of carrying out the invention is illustrated in the accompanying drawings, in which:

FIG. 1 is a perspective view of a typical hot air, gas furnace having original equipment conforming to the invention;

FIG. 2, a fragmentary vertical section taken along line 2—2 of FIG. 1, showing shutters on the combustion air inlet and the diverter air inlet in their closed position;

FIG. 3, a fragmentary view similar to that of FIG. 2, showing the shutters in the open position;

FIG. 4, a perspective view of the same type of furnace as conventionally constructed, but later modified to conform to the invention; and FIG. 5, an electrical diagram showing the furnace control system as modified in accordance with the invention.

DETAILED DESCRIPTION OF THE ILLUSTRATED EMBODIMENTS

A furnace having original equipment conforming to the invention is illustrated in FIGS. 1–3. The furnace comprises a housing having return air inlet 10 in one of the sides 11 thereof. The return air circulates through a conventional heat exchange plenum in the furnace, and heated air flows from the hot air outlet 12 on the top 13 of the furnace.

A gas or liquid fuel is burned at burner 14 within the combustion chamber 15 of the furnace. Ignition means are provided as part of the burner for igniting the fuel when fuel is fed to the burner. The ignition means commonly comprises a pilot flame which burns continuously. The draft system of the furnace provides for proper flow of combustion air into the combustion chamber 15 of the furnace to support combustion of the fuel.

As shown in FIGS. 1–3, the front 16 of the furnace is provided with two air openings 17 and 18, respectively. The upper or diverter air opening 17 provides for air flow to chamber 19 wherein hot exhaust gases from the outlet 20 of the combustion chamber 15 mix with the air from opening 17, and the mixture of gases are then exhausted through flue 21 at the top of the furnace. The introduction of air through opening 17 to chamber 19 prevents an excessive draft from being pulled through the combustion chamber 15 of the furnace. The operation and design of chamber 19 per se is well known in the art and does not form a part of the present invention.

The lower or combustion air opening 18 opens to a combustion air supply chamber 22 from which the combustion air is drawn into the combustion chamber 15. As is common in such furnaces, chamber 19 and the combustion air supply chamber 22 are separated by a partition 23 which provides a small opening 24 for flow communication therebetween. The small opening 24, as is well known in the art, prevents excessive pressure differentials from developing between chamber 19 and the combustion air supply chamber 22.

In accordance with this invention, two shutter plates 25 and 26 (FIGS. 2 and 3) are adapted to open and close the openings 17 and 18, respectively. The shutter plates 25 and 26 are pivotally connected along their lower edge to the front 16 of the furnace so that each of the shutter plates can be rotated back and forth between an essentially upright position as shown in FIG. 2, wherein the openings 17 and 18 are closed, and an essentially laterally extending position as shown in FIG. 3, wherein the openings 17 and 18 are open.

A linkage arm 27 is connected between the shutter plates 25 and 26 so that as the upper end of the arm 27 is pushed downwardly, the shutter plates 25 and 26 are simultaneously moved into their upright position closing the openings 17 and 18. Conversely, as the upper end of the linkage arm 27 is pulled upwardly, the shutter plates 25 and 26 are simultaneously moved into their laterally extending position, thereby opening the openings 17 and 18.

The upper end of the linkage arm 27 is connected to a motor drive unit 28 by a knee action linkage system 29. A spring 30 is provided which urges the knee action linkage system 29 to assume an extended position as shown in FIG. 2. In the extended position, the upper end of arm 27 is pushed downwardly, thereby closing the shutter plates 25 and 26 over the openings 17 and 18, respectively. When the motor drive unit 28 is activated, it moves the knee action linkage system against the force of spring 30 into an angled, drawn-up position as shown in FIG. 3. In this position, the upper end of arm 27 is pulled upwardly, and the shutter plates 25 and 26 are simultaneously moved into their laterally extending positions, thereby opening openings 17 and 18, respectively.

A conventionally constructed furnace which has been modified to conform to the present invention is shown in FIG. 4. This furnace is similar in its construction to the furnace shown in FIGS. 1 and 3, with the exception that the shutter plates 25 and 27 and system for opening and closing the air inlets 17 and 18, as built into the furnace of FIGS. 1–3, are not part of the original equipment of the furnace shown in FIG. 4. The furnace shown in FIG. 4 has a fuel burning and combustion gas exhausting system similar to that of the furnace shown in FIGS. 1–3. Combustion air is drawn through an opening in the front 16 of the furnace, and the combustion gases are exhausted through flue 21. As in the furnace of FIGS. 1–3, a second opening in the front of the furnace is provided communicating with a chamber similar to chamber 19 shown in FIG. 2. Air drawn through the second opening mixes with the hot exhaust gases coming from the combustion chamber in the same manner as hereinbefore described with respect to the furnace shown in FIGS. 1–3.

A shutter box 31 is attached to the front 16 of the furnace as shown in FIG. 4 to cover the openings in the furnace which communicate with respective chambers therein corresponding to chambers 15 and 19 as shown in the furnace illustrated in FIGS. 1–3. A set of shutter plates 32 are positioned in the shutter box 31, with the plates 32 being attached to a linkage arm 33, which when pushed upwardly simultaneously closes the shutter plates 32 and when pushed downwardly simultaneously opens the shutter plates 32. A motor drive unit 34, attached to the shutter box 31 and linkage arm 33, is adapted to push the linkage arm 33 downwardly to simultaneously open the shutter plates 32. The linkage arm 33 is biased by spring means which apply a constant force thereon in an upward direction. When the motor drive unit 34 is energized, it pushes the linkage arm 33 downwardly against the force of the spring means, thereby simultaneously opening the shutter plates 32.

When the motor drive unit 34 is de-energized, the spring means forces the linkage arm 33 to move in the opposite direction, thereby simultaneously closing the shutter plates 32.

The shutter plates 25 and 26 of the embodiment illustrated in FIGS. 1–3 and the shutter plates 32 of the embodiment illustrated in FIG. 4 are adapted to automatically open and close in response to preset conditions occurring in the operation of the furnace. The operation of the shutters and the furnace will be further explained with reference to electrical diagram of the furnace control system shown in FIG. 5.

The burning of fuel in the furnace is controlled primarily by the thermostat 35, as is conventional in such furnaces. The thermostat 35 is connected in series with one pole of the secondary winding of a transformer 36, a relay 37, and then to the other pole of the transformer 36. When the thermostat 35 makes contact, it energizes relay 37. In conventional furnaces, the relay 37 would in turn energize the automatic fuel control valve 38 thereby turning the furnace on.

In accordance with the present invention, the thermostat 35 does not control the automatic fuel control valve 38 of the furnace directly, but, instead, energizes the relay 37, thereby closing the two contacts **37*a* and 37*b* of the relay 37. Contact 37*a* is connected to the 120 volt supply to transformer 36, and when it is closed, the shutter motor 39 is energized. The motor 39 of FIG. 5 corresponds to the motor drive units 28 and 34 of FIGS. 1–3 and FIG. 4, respectively. The energization of the shutter motor results in the opening of shutters 25 and 26 of FIGS. 1–3 and of shutter plates 32 of FIG. 4**.

Contact **37*b* of relay 37 is connected with the automatic fuel control valve 38 through a series connection with a switch 40, which is, in turn, associated with the shutter plates. Switch 40 is closed when the shutter plates are in their full open position. The contact 37*b* of relay 37 having been closed, the circuit to the automatic fuel control valve 38 is completed when the switch 40 is closed, and the furnace turns on. It should be noted, however, that the furnace can not be turned on, i.e., fuel ignited therein, unless the shutter plates are in their fully open position. If they are not in the fully open position, the switch 40 will remain open, and the automatic fuel control valve 38** will not be activated.

A safety control unit 41 is associated with the automatic fuel control valve 38, as in conventional furnaces of the type illustrated. The safety control unit 41 serves as an override control of the automatic gas control valve, closing the valve in cases of pilot light malfunction or overheating of the heat exchange plenum in the furnace. The unit 41 performs such functions independent of the improved draft system of this invention. A fan control 42 is also shown in FIG. 5 which controls the operation of the furnace fan motor 43. The operation of the fan control and the furnace fan is also independent of the present invention. The safety control unit 41, fan control 42, and fan motor 43 are shown simply as a part of the total electrical diagram of a typical furnace which otherwise conforms to the present invention.

As long as the thermostat 35 indicates a need for heat and, therefore, as long as fuel is being burned in the furnace, the relay 37 remains energized and the shutter plates remain open, thereby allowing air to flow through the furnace draft system. As soon as the heat requirement has been satisfied, the thermostat 35 breaks its connection to the relay 37, which, in turn, de-energizes the motor 39 on the shutter drive unit, and the shutters close under the spring forces which are associated therewith. As the shutters initiate their closure, the switch 40 is disconnected, and the automatic fuel control valve 38 turns off so that fuel flow to the furnace ceases. Thus, when the furnace has been turned off, and it is in its standby condition, the shutters close the openings to the combustion chamber and flue of the furnace, thereby preventing heat loss due to warm air from the interior of the building escaping to the exterior through the flue and chimney of the furnace. In addition, unnecessary cooling of the furnace heat exchanger by air flowing from the building through the flue and chimney is also prevented.

The draft control system of the present invention is safe, even in cases of malfunction of one or more of the component parts thereof. The shutter system must be in its fully open position for the furnace to ignite. Even if the switch 40 failed and remained in its closed position indefinitely and the motor 39 or some other component of the shutter system simultaneously failed so that ignition of the furnace could occur while the shutter system remains closed, there is no serious safety problem. The fuel introduced into the combustion chamber would burn with incomplete combustion due to the limited air which could be drawn into the combustion chamber of the furnace through the closed shutter system. The incomplete products of combustion would be exhausted to the exterior of the building through the flue and chimney so that they would not present a fume problem within the building. The heating efficiency of the furnace would drop significantly, thus calling attention to the inhabitants of the building that some malfunction had occurred in the furnace, and the malfunction would then be corrected.

In systems which have been proposed heretobefore of placing a damper in the flue or chimney of the furnace, a severely hazardous situation exists if the damper does not open. In such situations, the combustion gases are released to the inside of the building being heated, and thus, present an air contamination or fume problem along with a fire hazard. In accordance with the present invention both of these problems, and at least about a 20 percent reduction in fuel consumption is obtained as compared to conventional furnaces which do not conform to the present invention.

Whereas this invention is here illustrated and described with specific reference to embodiments thereof presently contemplated as the best mode of carrying out such invention in actual practice, is to be understood that various changes may be made in adapting the invention to different embodiments without departing from the broader inventive concepts disclosed herein as comprehended by the claims that follow.

I claim:

1. In a space heating furnace which includes a combustion chamber, a gas or liquid fuel burner in said combustion chamber, means for feeding a gas or liquid fuel to said burner, means for igniting said fuel, and a draft system comprising a combustion air inlet on said furnace and passages for conducting combustion air to the combustion chamber, an exhaust flue for conducting combustion gases from said combustion chamber to an exhaust stack, and a diverter air inlet on said furnace and passages for conducting air to said flue to mix with said combustion gases, the improvement comprising means for closing said combustion air inlet and said diverter air inlet when fuel is not being introduced into said combustion chamber; and means for opening said combustion air inlet and said diverter air inlet when fuel is being introduced into said combustion chamber.

2. A furnace in accordance with claim 1, wherein the means for closing and opening the combustion air inlet and the diverter air inlet comprises a shutter positioned over said combustion air inlet and said diverter air inlet.

3. A furnace in accordance with claim 2, wherein spring means are provided for normally urging the shutter closed, thereby closing the combustion air inlet and the diverter air inlet, and wherein a motor drive is provided for opening the shutter against the force of said spring means, thereby opening the combustion air inlet and the diverter air inlet when said motor drive is energized.

4. A furnace in accordance with claim 3, wherein a thermostat is provided which controls an automatic fuel control valve of the furnace and also provides the means for energizing the motor drive.

5. The space heating furnace of claim 1 wherein the means for closing said combustion air inlet and said diverter air inlet comprises apparatus adapted to be attached to the combustion air inlet and the diverter air inlet of a space heating furnace which burns a gas or liquid fuel, said apparatus comprising means for opening the combustion air inlet and the diverter air inlet when fuel is being burned in the furnace, and means for closing the combustion air inlet and diverter air inlet when burning of the fuel is discontinued.

6. In a space heating furnace which includes a combustion chamber, a gas or liquid fuel burner in said combustion chamber, means for feeding a gas or liquid fuel to said burner including an automatic fuel control valve, means for igniting said fuel, and a draft system comprising a combustion air inlet and passages for conducting combustion air to the combustion chamber, an exhaust flue for conducting combustion gases from said combustion chamber to an exhaust stack, and a diverter air inlet and passages for conducting air to said flue to mix with said combustion gases, the improvement comprising shutter means for closing said combustion air inlet and said diverter air inlet when fuel is not being introduced into said combustion chamber; spring means for normally urging the shutter means closed, thereby closing the combustion air inlet and the diverter air inlet; a motor drive for opening the shutter means against the force of said spring means; a thermostat for controlling the automatic fuel control valve of the furnace and for causing energization of the motor drive, said thermostat being connected to a relay which operates a switch connecting an electric potential to the motor drive, a second switch provided in combination with the shutter means so as to connect an electrical potential to the automatic fuel control valve, whereby when the thermostat is activated, said relay closes the switch to the motor drive causing the shutter means to open, and when the shutter means opens, the second switch is closed and the automatic gas valve opens and the furnace ignites, and when the thermostat is deactivated, said relay opens the switch to the motor drive causing the shutter means to close, and when the shutter means closes, the second switch opens and the automatic fuel valve closes, thereby shutting off the fuel supply to the furnace.

* * * * *